US006142394A

United States Patent [19]

Hefler et al.

[11] Patent Number: 6,142,394

[45] Date of Patent: Nov. 7, 2000

[54] VALVE SEAT FOR A BALL AND PIN VALVE MEMBER IN A HYDRAULICALLY ACTUATED FUEL INJECTOR

[75] Inventors: Gregory W. Hefler, Chillicothe; Brian J. Murphy, Morton, both of Ill.

[73] Assignee: Caterpillar Inc., Peoria, Ill.

[21] Appl. No.: 09/343,374

[22] Filed: Jun. 30, 1999

[51] Int. Cl.[7] ..... F02M 47/02

[52] U.S. Cl. ..... 239/533.8; 239/533.2; 251/129.14

[58] Field of Search ..... 239/585.1, 533.8, 239/533.2, 533.3, 533.9, 900, 96, 585.2, 585.3, 585.5; 137/625.65, 596.17, 625.64; 251/129.14, 129.16

[56] References Cited

U.S. PATENT DOCUMENTS

| | | | |
|---|---|---|---|
| 3,731,880 | 5/1973 | Williams | 239/585 |
| 4,434,765 | 3/1984 | Eshelman | 239/900 |
| 4,509,716 | 4/1985 | Barber et al. | 251/141 |
| 4,620,565 | 11/1986 | Brown | 137/596.17 |
| 4,635,849 | 1/1987 | Igashira et al. | 239/533.3 |
| 4,722,482 | 2/1988 | Jordan et al. | 239/900 |
| 4,951,703 | 8/1990 | Brehm et al. | 137/315 |
| 4,997,004 | 3/1991 | Barkhimer | 137/596.17 |
| 5,145,148 | 9/1992 | Laurent | 251/129.14 |
| 5,160,116 | 11/1992 | Suguira et al. | 251/129.14 |
| 5,467,797 | 11/1995 | Seetharaman et al. | 137/599 |
| 5,556,175 | 9/1996 | Hayakawa et al. | 251/129.14 |
| 5,606,992 | 3/1997 | Erickson et al. | 137/596.17 |
| 5,617,894 | 4/1997 | Wolff | 137/625.5 |
| 5,720,318 | 2/1998 | Nagarajan et al. | 239/533.3 |
| 5,820,032 | 10/1998 | Reiter | 239/900 |
| 5,833,146 | 11/1998 | Hefler | 239/533.8 |

FOREIGN PATENT DOCUMENTS 828073 3/1998 European Pat. Off. .

*Primary Examiner*—Lesley D. Morris
*Assistant Examiner*—Dinh Q. Nguyen
*Attorney, Agent, or Firm*—Eric M. Bram

[57] ABSTRACT

A hydraulically actuated device comprises a device body defining an inlet passage separated from an outlet passage by a first valve seat and a second valve seat, and a control passage that opens into an area between the first valve seat and the second valve seat. An essentially spherical ball valve member having a first radius of curvature is trapped between the first valve seat and the second valve seat. The inlet passage is fluidly isolated from the control passage by the ball valve member when the ball valve member is in contact with the first valve seat, and the outlet passage is fluidly isolated from the control passage by the ball valve member when the ball valve member is in contact with the second valve seat. An electrical actuator is attached to the device body. A pin is movable by operation of the electrical actuator to come into contact with and push against the ball along a curved striking surface of the pin having a second radius of curvature that is larger than the first radius of curvature.

22 Claims, 3 Drawing Sheets

VALVE SEAT FOR A BALL AND PIN VALVE MEMBER IN A HYDRAULICALLY ACTUATED FUEL INJECTOR

TECHNICAL FIELD

The present invention relates generally to hydraulically actuated devices having ball valve members, and more specifically to hydraulically actuated fuel injectors that use a ball and pin valve member to control actuation fluid flow into and out of the injector.

RELATED ART

Hydraulically-actuated fuel injection systems and/or components are known, for example in U.S. Pat. No. 5,121,730 issued to Ausman et al. on Jun. 16, 1992; U.S. Pat. No. 5,271,371 issued to Meints et al. on Dec. 21, 1993; and U.S. Pat. No. 5,297,523 issued to Hafner et al. on Mar. 29, 1994. In these hydraulically actuated fuel injectors, a spring biased needle check opens to commence fuel injection when pressure is raised by an intensifier piston/plunger assembly to a valve opening pressure.

The intensifier piston is acted upon by a hydraulic actuation fluid, such as engine lubricating oil, when a solenoid driven actuation fluid control valve opens the injector's high pressure inlet. Injection is ended by deactivating the solenoid to release pressure above the intensifier piston. This in turn causes a drop in fuel pressure causing the needle check to close under the action of its return spring and end injection.

The initiation of an injection event in all these hydraulically-actuated fuel injectors is started by energizing a solenoid to move an actuation fluid control valve to open the high pressure actuation fluid inlet passage to the injector. While some versions of this actuation fluid control valve utilize a poppet valve member or a spool valve member attached to the armature of a solenoid, other versions utilize a ball and pin valve—a simple pin attached to the solenoid to move a ball between opposing valve seats.

In order to prevent the possible breakage of the pin in these control valve assemblies, it is necessary that the bore guiding the pin as well as the two valve seats be closely aligned along a common axis. The potential for pin breakage is important in fuel injectors utilizing control valves of this type since the pin must necessarily be relatively small and must be able to withstand the pounding of many impacts per second with the ball and seats. Any misalignment creates a side force on the pin that eventually will lead to breakage and failure of the fuel injector.

Various approaches have been taken to address this problem. In U.S. Pat. No. 5,833,146 to Hefler, a ball and pin valve assembly is disclosed in which a pin pushes a ball against a first annular valve seat, and hydraulic fluid pressure pushes the ball back against a second annular valve seat when the pin is withdrawn. This valve is incorporated into a fuel injector having an injector body that includes a nozzle chamber that opens to a nozzle outlet. A hydraulic means within the injector body pressurizes fuel in the nozzle chamber. A needle valve member is positioned to reciprocate in the nozzle chamber between an opened position in which the nozzle outlet is open and a closed position in which the nozzle outlet is closed.

In ball and pin valves like the one described above, the pin strikes the ball with great force, and drives the ball against the first annular valve seat with great force. Not surprisingly, this can cause deformations of the first annular valve seat.

This can actually be beneficial, because slight deformations of a portion of the seat to match the curvature of the ball can cause a better seal of the ball against the seat.

However, wear of the pin caused by the pin's striking the ball is more serious. Wear of the pin and degradation of its shape where it contacts the ball can cause changes and irregularities in performance. For example, if the shape of the pin changes it can be more prone to knocking the ball out of alignment, which will retard accomplishing the seal of the ball against the seat.

U.S. Pat. No. 4,997,004 to Barkhimer does not teach this problem, and indeed does not address shaping the pin of a ball and pin valve at all, but it does disclose shaping a seat in various ways to help hold the ball in axial alignment with its seat and to minimize wear of the valve seat. Various types of straight edge slopes and spherical seating surfaces are disclosed, including a ball seat concavity having a compound curvature consisting of a spherical bottom portion and a forwardly and outwardly flared lead-in portion. However, the straight edge slope valve seat puts a great deal of stress on a small area.

The spherical valve seat configuration has the advantage that the load can be distributed over the entire circle surface of the concavity, but initial engagement of the ball striking an outer forward edge of the concavity when the ball is out of axial alignment even slightly can cause wear as well.

The compound curvature can alleviate this problem somewhat because when the ball is slightly out of alignment it will strike the flared edge of the concavity. However, accurately milling the proper curvature for manufacture of a compound curvature can be difficult and expensive.

DISCLOSURE OF THE INVENTION

A hydraulically actuated device comprises a device body defining an inlet passage separated from an outlet passage by a first valve seat and a second valve seat, and a control passage that opens into an area between the first valve seat and the second valve seat. An essentially spherical ball valve member having a first radius of curvature is trapped between the first valve seat and the second valve seat. The inlet passage is fluidly isolated from the control passage by the ball valve member when the ball valve member is in contact with the second valve seat, and the outlet passage is fluidly isolated from the control passage by the ball valve member when the ball valve member is in contact with the first valve seat. An electrical actuator is attached to the device body. A pin is movable by operation of the electrical actuator to come into contact with and push against the ball along a curved striking surface of the pin having a second radius of curvature that is larger than the first radius of curvature.

DETAILED DESCRIPTION

Figure 1:
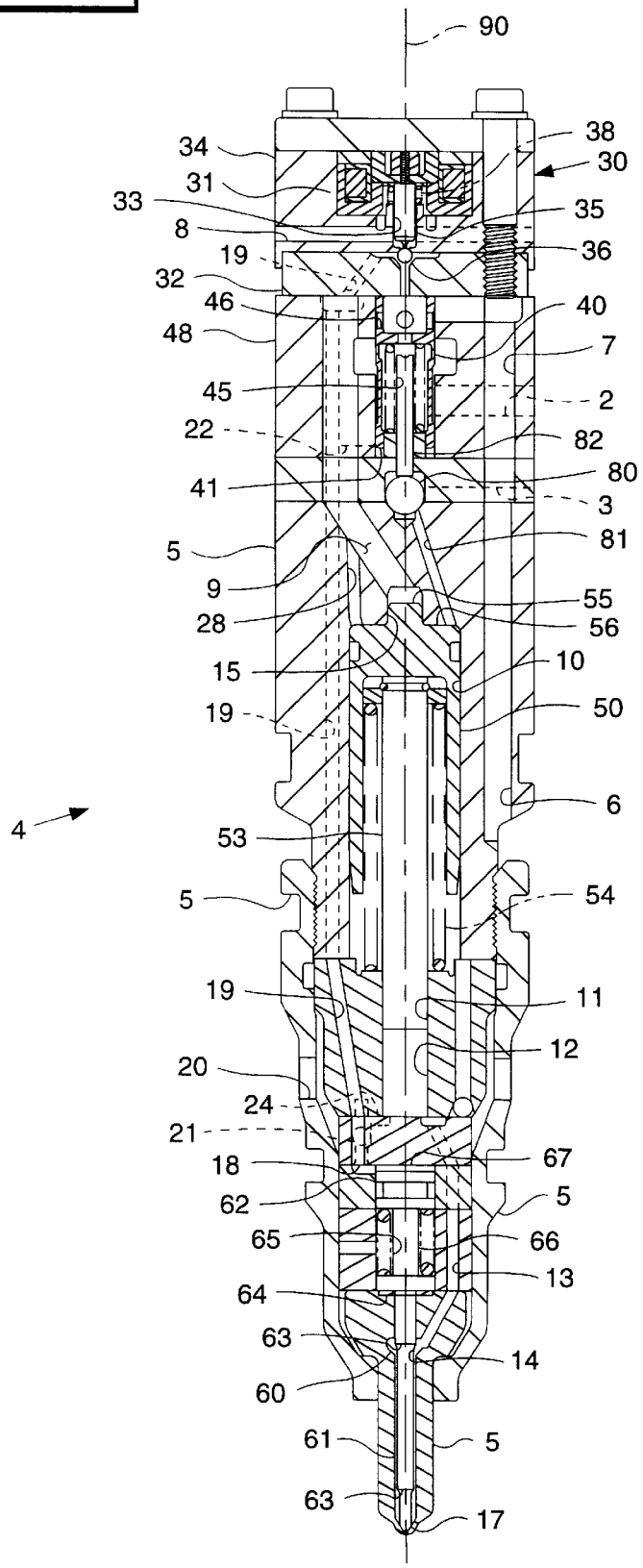
FIG. 1 is a sectioned side elevational view of a fuel injector according to the present invention.
Figure 2:
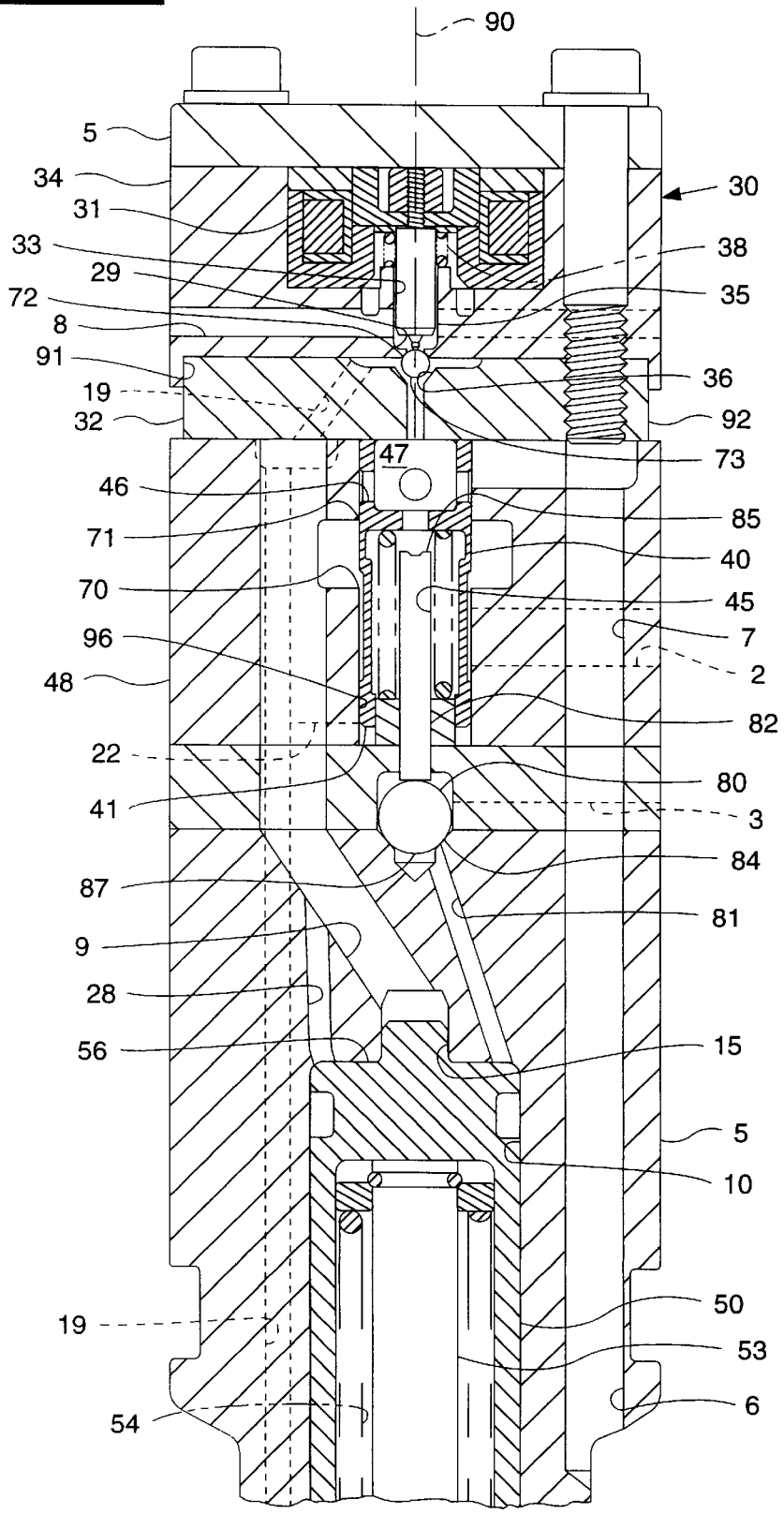
FIG. 2 is a partial sectioned side elevational view of an upper portion of the fuel injector shown in FIG. 1.
Figure 3:
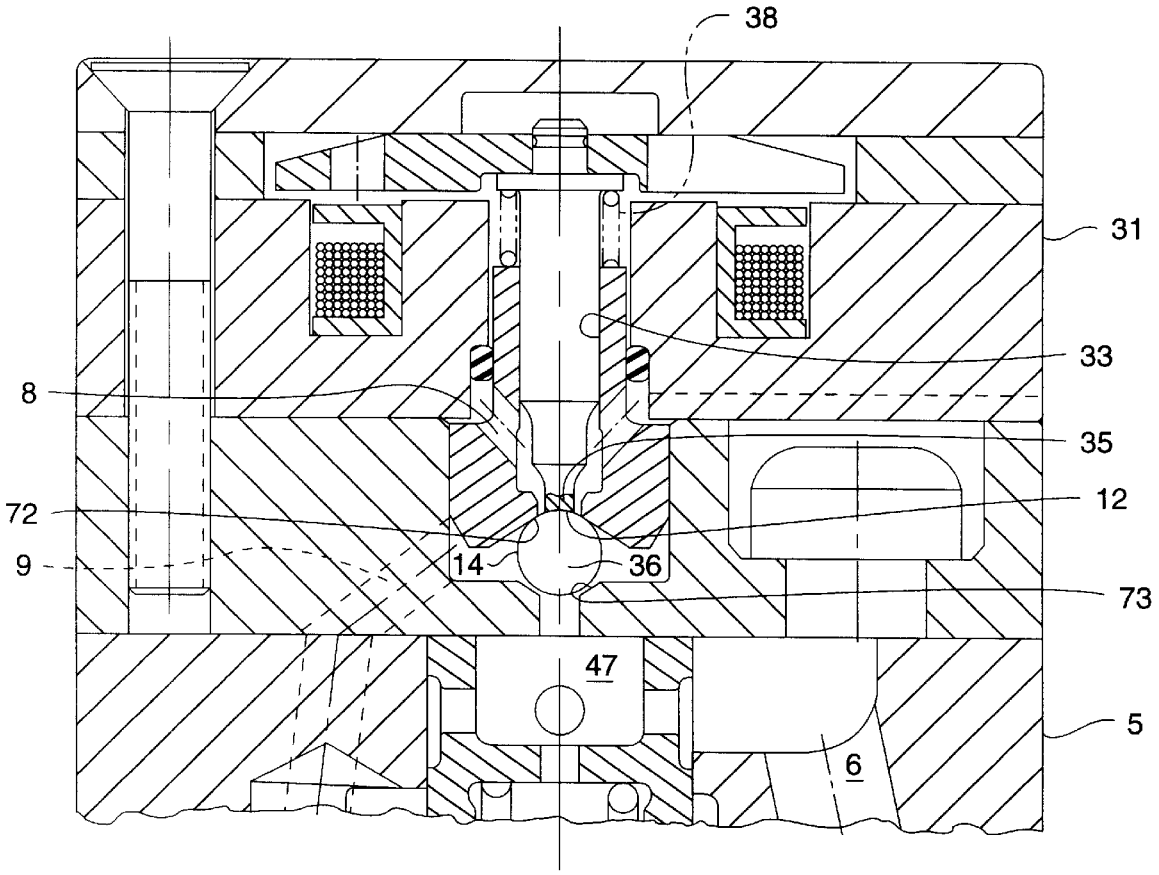
FIG. 3 is a representational partial sectioned side elevational view of the ball and pin valve area of an upper portion of a fuel injector similar to the fuel injector shown in FIG. 1.

Referring now to FIGS. 1–3, fuel injector 4 utilizes a single two-way solenoid 31 to alternately open actuation fluid cavity 9 to actuation fluid inlet passage 6 or low pressure actuation fluid drain 8. The high pressure actuation fluid entering actuation fluid cavity 9 is used to apply pressure to an intensifier piston 50 or such to begin and end fuel injection, by various methods known in the art.

Injector 4 includes an injector body 5 having an actuation fluid inlet passage 6 that is connected to source of high pressure actuation fluid, such as lubricating oil, an actuation fluid drain 8 that is connected to a low pressure actuation fluid re-circulation line, and a fuel inlet 20 connected to a source of fuel. Injector 4 includes a hydraulic means for pressurizing fuel within the injector during each injection event and a needle control valve that controls the opening and closing of nozzle outlet 17.

The illustrated embodiment has a two-position actuation fluid control valve that includes a a solenoid 31 with an armature attached to a pin 35, and ball valve member (ball) 36 movable between an upper annular seat 72 and a lower annular seat 73. Other embodiments using the invention may utilize other types of electrical actuators 31 to move the pin 35, for example a piezo stack actuator.

Because during operation an end of the pin 35 will strike the ball 36, to reduce wear and chipping of the pin 35 the tip of the pin is made of a sufficiently tough material to handle the point loading that occurs when it strikes the ball 36. Additionally, the striking surface of the tip of the pin 35 is given a spherically concave shape to better absorb the impact of hitting the ball 36. Further, to spread the impact force over a wider striking surface, the cross-sectional diameter of the tip of the pin 35 is increased. This requires the diameter of the sleeve surrounding the tip of the pin 35 to the increased as well, in order to maintain proper fluid flow.

To achieve acceptable wear life for the pin 35, ideally the hardness of the pin tip 35 material should be between 55 and 62 Rockwell C (Rockwell C is a well-known scale for measuring hardness). Toughness can be defined by the "critical crack length" (K1C) of a material. The toughness of the pin 35 material should be such that $K1C \geqq 25$ MPa√m where Mpa is mega-pascals and m is meters.

For best results, the striking surface area 12 of the pin 35 should be made large enough so that the maximum load P on the pin 35 generated when the pin 35 strikes the ball 36 divided by the area of the striking surface 12 of the pin 35 is 1200 MPa or less.

The spherical radius of the concave shape of the end of the pin 35 is mismatched with the spherical radius of the ball 36. Specifically, the radius of curvature of the concave depression 12 in the tip of the pin 35 is greater than the radius of curvature 14 of the ball 36. That is, the striking surface at the tip of the pin 35 is slightly flatter than the surface of the ball 36 to ensure that the ball 36 does not contact the pin 35 at its edge, which may cause chipping.

With use, the striking surface 12 of the pin tip 35 will deform to match the curvature of the ball 36 across a considerable percentage of the striking surface 12 of the pin 35. To prevent chipping the material hardness, toughness, and dimensions must be chosen in accordance with the forces involved so that the deformation area does not extend all the way to the edge of the striking surface 12. At the same time, the deformation area should be large enough to handle the maximum load P on the pin 35 as described above. The example combination of toughness, hardness, dimensions, etc. discovered by the applicants and described herein will achieve these results for the illustrated embodiment.

The exact difference in radii of curvature that can be used with this invention may vary, but the differential radius (the difference between the two radii of curvature) must be large enough so that given the tolerances of the pin 35, the ball 36, and the motion of the pin 35 relative to the ball 36, there is a negligible chance that the sharp edge of the pin 35 strikes the ball 36 first. However, if the differential is too large it may cause cracking of the pin 35, because too much of the force of impact will be delivered to too small an initial area of the pin 35.

For the toughness and hardness ranges discussed above, differential radius of curvature of the tip (striking) surface of the pin 35 should be somewhat larger, but no more than about 60 percent, and preferably just about half, of the radius of curvature of the ball 36. For example, in the illustrated embodiment the ball 36 has a diameter of 3.175 mm, and therefore has a radius of curvature of about 1.6 mm. The preferred maximum differential radius is about 0.8 mm. That is, the concave depression (striking surface) in the tip of the pin 35 is kept within 0.8 mm larger of the radius of curvature 14 of the ball 36.

In the illustrated embodiment the shape of the receiving sleeve forming the lower annular seat 73 is conical to reduce edge load as the ball 36 strikes the lower annular seat 73. The seat can also be curved if desired to reduce somewhat the line load of the ball 36 striking the lower annular seat 73.

As is typical, injector body 5 is made up of many machined bodies that include the various passages and bores, which are attached to one another so as to ensure a close alignment between the centers of pin guide bore 33, the upper annular valve seat 72, and the lower annular valve seat 73.

Industrial Applicability

The actuation fluid control valve of injector 4 can be thought of as including the two-way solenoid 31 that is attached to a pin 35, which remains in contact with ball 36 except when pin 35 is fully retracted. Pin 35 is biased by a compression spring 38 and the hydraulic force on ball 36 toward a retracted position (as shown in FIG. 3). In this position, the ball 36 closes the upper annular seat 72 and opens the lower annular seat 73. This allows high pressure actuation fluid to flow into the actuation fluid cavity 9.

Each injection sequence is started by energizing solenoid 31. When solenoid 31 is energized, pin 35 moves downward pushing ball 36 to open the upper annular seat 72 and close the lower annular seat 73. This cuts off the high pressure hydraulic fluid in the actuation fluid inlet 6 from the actuation fluid cavity 9, and simultaneously opens the actuation fluid cavity 9 to the low pressure actuation fluid drain 8.

As stated previously, the tip of the pin 35 and the ball 36 have cooperating spherical services, to spread the impact of the pin 35 striking the ball 36 over a sufficient area. However, as stated above, the tip of the pin 35 and the ball 36 have mismatched striking areas. That is, they are formed so that their services have different spherical radii. This ensures that contact between the pin and the ball is at or very close to the axis center, and not at the edges of the tip of the pin 35, which could cause chipping of the pin 35.

As explained above, the pin 35 must be made of sufficient toughness. There are several reasons for this. Initially, the toughness must be great enough for the pin 35 to handle the impact loads that occur when the ball 36 strikes it. Additionally, the pin 35 must be of sufficient toughness to allow the point load of the ball 36 striking the pin 35 to plastically Dedeform and wear into the pin tip to provide sufficient area to support the impact loads.

To end injection and allow the injector to re-fuel itself for the next cycle (or to begin injection in other embodiments), solenoid 31 is de-energized. This causes ball 36 to move to open seat 73 and close seat 72. This allows the high pressure hydraulic fluid from the actuation fluid inlet 6 to flow through hollow space 47, past the ball 36, and into the actuation fluid cavity 9.

Other aspects and advantages of this invention can be obtained from a study of the drawings, the disclosure, and the appended claims.

We claim:

1. A hydraulically actuated device comprising:

a device body defining an inlet passage separated from an outlet passage by a first valve seat and a second valve seat, and a control passage that opens into an area between the first valve seat and the second valve seat;

a spherical ball valve member trapped between the first valve seat and the second valve seat, the ball valve member having a first radius of curvature;

said inlet passage being fluidly isolated from the control passage by the ball valve member when the ball valve member is in contact with the first valve seat, and the outlet passage being fluidly isolated from the control passage by the ball valve member when the ball valve member is in contact with the second valve seat;

an electrical actuator attached to the device body; and a pin movable by operation of the electrical actuator to come into contact with and push against the ball along a curved striking surface of the pin, the striking surface having a second radius of curvature larger than the first radius of curvature.

2. The hydraulically actuated device of claim 1 wherein the pin pushes against the ball to fluidly isolate the inlet passage from the control passage by pushing the ball valve member into contact with the first valve seat.

3. The hydraulically actuated device of claim 2 wherein the ball valve member comes into contact with the first valve seat against a curved surface of the first valve seat having a third radius of curvature larger than the first radius of curvature.

4. The hydraulically actuated device of claim 1 wherein the electrical actuator is a solenoid.

5. The hydraulically actuated device of claim 1 wherein the electrical actuator is a piezo stack.

6. The hydraulically actuated device of claim 1 wherein the inlet passage is fluidly connected to a source of high pressure hydraulic fluid; and said outlet passage is fluidly connected to a volume of low pressure hydraulic fluid.

7. A hydraulically actuated device of claim 1, further comprising a fuel inlet fluidly connected to a source of engine fuel, and wherein the ball valve member comes into contact with the first valve seat against a conical surface of the first valve seat.

8. The hydraulically actuated device of claim 1 wherein the engine fuel is at all times fluidly isolated from the control passage.

9. The hydraulically actuated device of claim 1 wherein the pin defines a portion of the outlet passage.

10. A process of constructing the hydraulically actuated device of claim 1.

11. A hydraulically actuated fuel injector for injecting a fuel fluid into an engine, the hydraulically actuated fuel injector comprising:

a device body;

an electrical actuator attached to the device body;

a ball valve member having a first radius of curvature;

a first annular valve seat disposed for receiving the ball valve member; and a pin disposed within the device body and movable by operation of the electrical actuator to push against the ball valve member along a striking surface of the pin until the ball valve member mates with the first annular valve seat to close off a first fluid passage, the striking surface having a second radius of curvature larger than the first radius of curvature.

12. The hydraulically actuated fuel injector of claim 1, further comprising a second annular valve seat surrounding a second fluid passage and disposed for receiving the ball valve member;

wherein the pin is disposed within the device body to extend through the second fluid passage to come into contact with the ball valve member.

13. The hydraulically actuated fuel injector of claim 11 wherein the electrical actuator is a solenoid.

14. The hydraulically actuated fuel injector of claim 11 wherein the electrical actuator is a piezo stack.

15. The hydraulically actuated fuel injector of claim 11 wherein the first fluid passage is an inlet passage fluidly connected to a source of high pressure hydraulic fluid and the second fluid passage is an outlet passage fluidly connected to a volume of low pressure hydraulic fluid.

16. The hydraulically actuated fuel injector of claim 11 further comprising a fuel inlet for admitting fuel fluid to the fuel injector, wherein a hydraulic fluid supplied to the first fluid passage is fluidly isolated from the fuel fluid admitted via the fuel inlet.

17. The hydraulically actuated fuel injector of claim 16 wherein the fuel fluid is one of gasoline and diesel fuel and the hydraulic fluid is engine lubricating oil.

18. The hydraulically actuated fuel injector of claim 11, wherein said second radius of curvature is no more than 60 percent greater than said first radius of curvature.

19. Hydraulically actuated fuel injector of claim 18, wherein said second radius of curvature is no more than 50 percent greater than said first radius of curvature.

20. The hydraulically actuated fuel injector of claim 11, wherein said pin comprises material of hardness between 55 and 62 Rockwell C.

21. The hydraulically actuated fuel injector of claim 11, wherein said pin comprises material of a toughness corresponding to $K1C \geqq 25$ MPa√m.

22. The process of constructing the hydraulically actuated fuel injector of claim 11.

* * * * *